US007488189B1

(12) United States Patent
Hung

(10) Patent No.: US 7,488,189 B1
(45) Date of Patent: Feb. 10, 2009

(54) REMOVING MEMBER FOR ELECTRONIC

(75) Inventor: Tzu-Chieh Hung, Taipei Hsien (TW)

(73) Assignee: Wistron Corporation, Hsichih, Taipei Hsien (TW)

( * ) Notice: Subject to any disclaimer, the term of this patent is extended or adjusted under 35 U.S.C. 154(b) by 0 days.

(21) Appl. No.: 12/123,534

(22) Filed: May 20, 2008

(51) Int. Cl.
*H01R 13/62* (2006.01)

(52) U.S. Cl. ..... 439/153; 439/159

(58) Field of Classification Search ..... 439/152–160, 439/372; 361/684, 686, 726, 747, 798
See application file for complete search history.

(56) References Cited

U.S. PATENT DOCUMENTS 3,636,413 A * 1/1972 Ditthardt et al. ..... 361/726
6,015,308 A * 1/2000 Lee et al. ..... 439/155
6,069,790 A * 5/2000 Howell et al. ..... 361/686
RE37,265 E * 7/2001 Lwee ..... 439/157
6,373,713 B1 * 4/2002 Jensen et al. ..... 361/759

* cited by examiner

*Primary Examiner*—Khiem Nguyen
(74) *Attorney, Agent, or Firm*—Ming Chow; Sinorica, LLC

(57) ABSTRACT

A removing for electronics is revealed. The electronic device includes an electronic member and a housing while the electronic member is disposed inside the housing. A removing member is arranged on the electronic member. A releasing member is pivoted on one side of the electronic member. A pulling part is disposed on a first end of the releasing member while a slot is mounted on one side of the housing and the pulling part is inserted inside the slot. A fixing member is arranged on a second end of the releasing member and is mounted in a fixing hole of the electronic member. When the electronic member is exactly installed inside the housing, the pulling part is located inside the slot so as to avoid damages of the electronic members caused by removing or unexacting assembling.

14 Claims, 5 Drawing Sheets

REMOVING MEMBER FOR ELECTRONIC

BACKGROUND OF THE INVENTION

The present invention relates to a removing member, especially to a removing member for electronics.

Due to fast development of computer technology, computers are getting more involved with our daily lives. Thus network flow is increasing day after day and the demands for servers are increasing. In order to organize the servers more efficiently for dealing with high network flow, a blade server has been developed.

A processor, memory, hard disc and other elements are packaged on a card (blade). These blades (cards) can operate independently within a common chassis. The blade server has high expandability, supports Plug and Play. The circuit board is able to be replaced under the power-off condition. Due to frequent movement of the blades, a plurality of rails is disposed on tow sides of the chassis so that the blades are mounted into the chassis along with the rails and then are fastened on the chassis by screws. In order to ensure that the blades are firmly fixed on the chassis, a handle is arranged on one side of the blade so as to confirm normal connection between the blade and the chassis.

Refer to Taiwanese patent No. M296421-a locating mechanism for a handle of a ATCT card, a detection switch 13, a locking member 23 and a clipping elastic arm 33 are used to check whether a motherboard is located exactly. The clipping elastic arm 33 locks with the locking member 23. After a plurality times of plugging and removing of the motherboard, the clipping elastic arm 33 has deformed and failed to lock with the e locking member 23 so that the motherboard can't work normally. Moreover, there is no indictor to show whether the motherboard is located exactly and this causes inconvenience in plugging and removing of the motherboard. Furthermore, this device requires several elements such as the detection switch 13, the handle 2 and the locating elastic piece 3 to locate the motherboard so that the manufacturing cost is increased. Once the motherboard can be located with fewer locating elements, it's more convenient to replace the mother board and the cost is reduced.

Thus there is a need to provide a removing member for electronics that not only locates the motherboard exactly with less locating members but also shows whether the motherboard is located or not.

SUMMARY OF THE INVENTION

Therefore it is a primary object of the present invention to provide a removing member for electronics that uses a releasing member having a releasing member pivoted on one side of an electronic member, a pulling part arranged on the releasing member and a slot arranged on a housing. When the electronic member is installed inside the housing exactly, the pulling part is located inside the slot so as to avoid damages of the electronic member caused by disassembling or unexacting installation.

It is another object of the present invention to provide a removing member for electronics that uses a fixing member arranged on the releasing member while both the fixing member and the releasing member are conductors. Moreover, a fixing hole of the electronic member as well as the releasing member is respectively electrically connected with the electronic member. When the electronic member is set inside the housing exactly, the fixing member inserts into the fixing hole so that the electronic member can work normally. Moreover, damages of electronic members caused by removing or unexacting assembling can be avoided.

Furthermore, the releasing member and the fixing member are conductors while the releasing member and the fixing hole respectively are electrically connected with the electronic member. Thus when the electronic member is exactly assembled inside the housing, the fixing member inserts into the fixing hole so that the electronic member can work normally. Moreover, damages of electronic members caused by removing or unexacting assembling can be avoided.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1A:
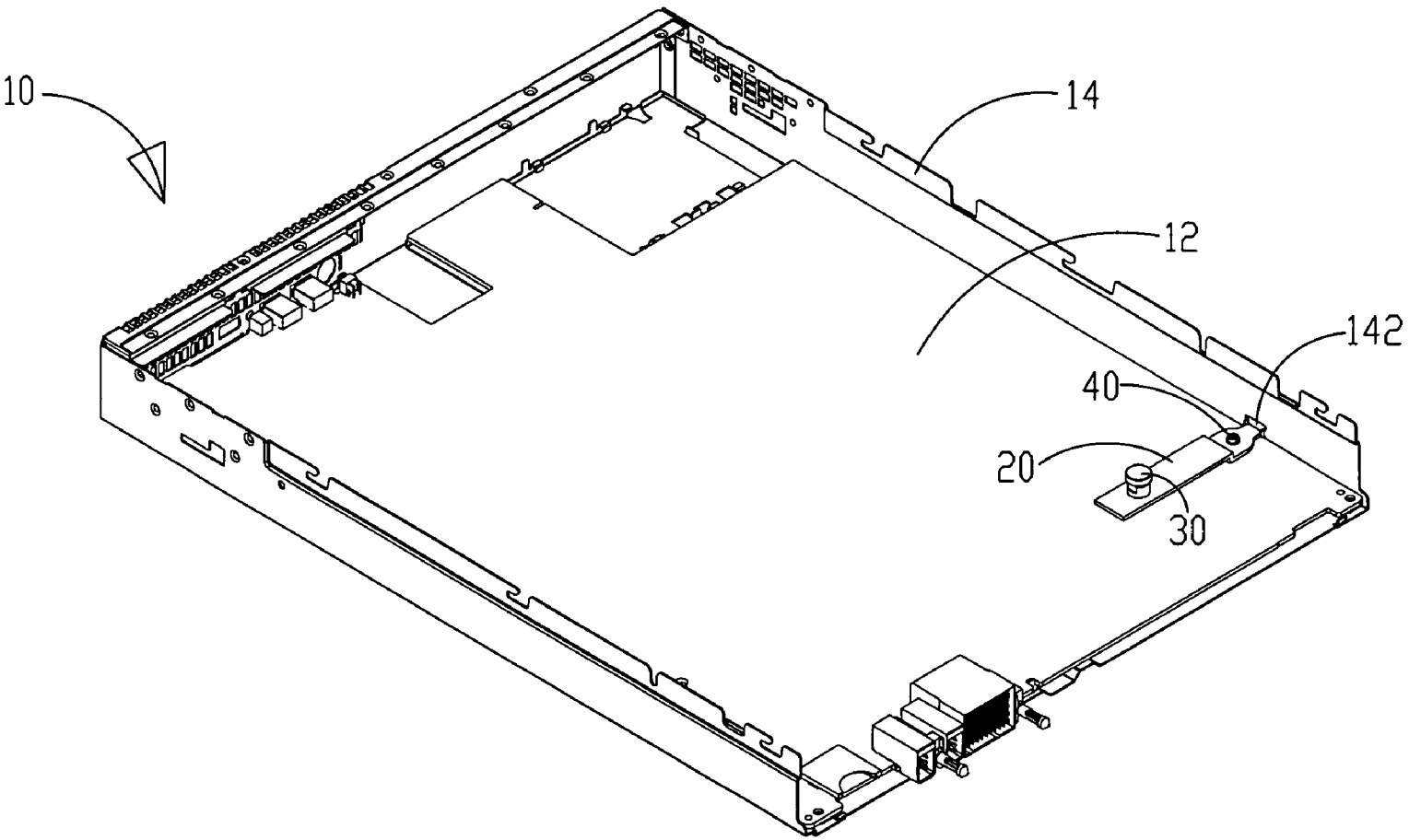
FIG. 1A is a perspective view of an embodiment according to the present invention.
Figure 1B:
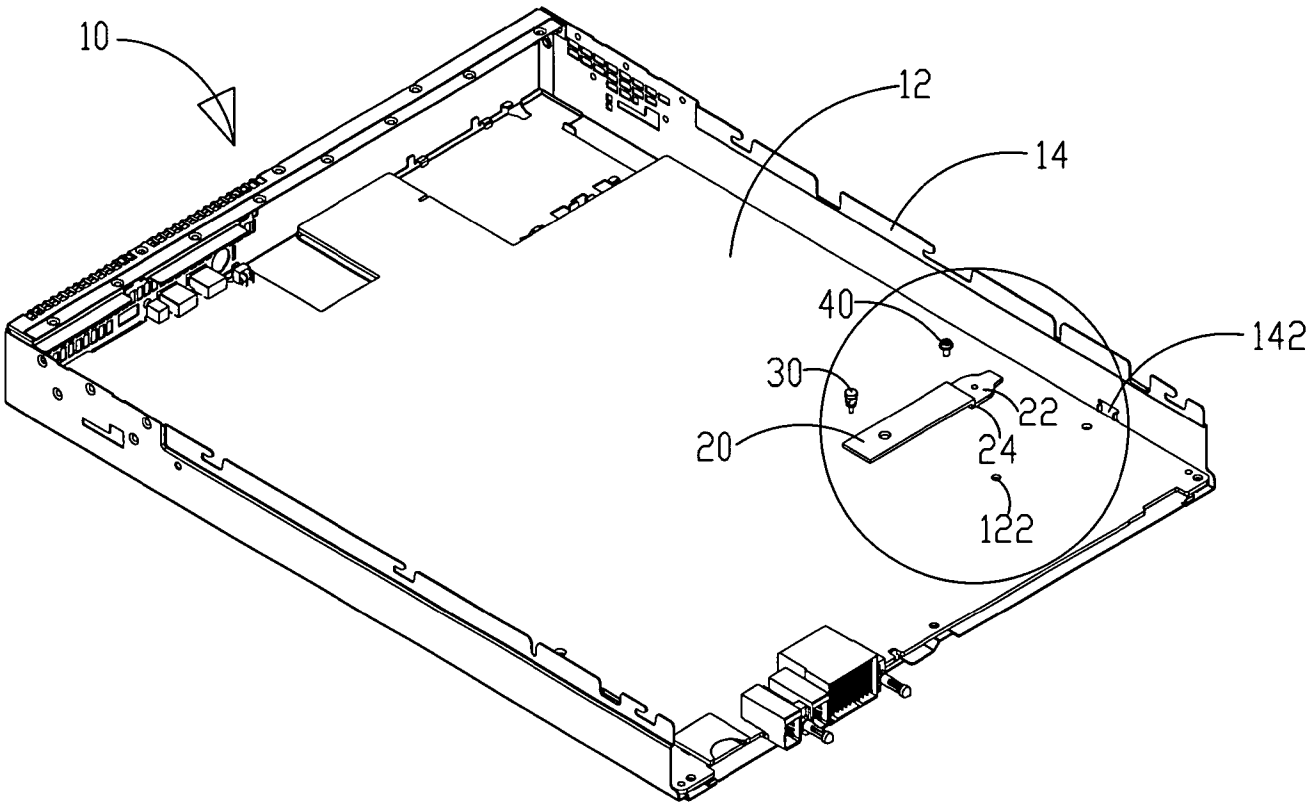
FIG. 1B is a partial explosive view of an embodiment according to the present invention.
Figure 1C:
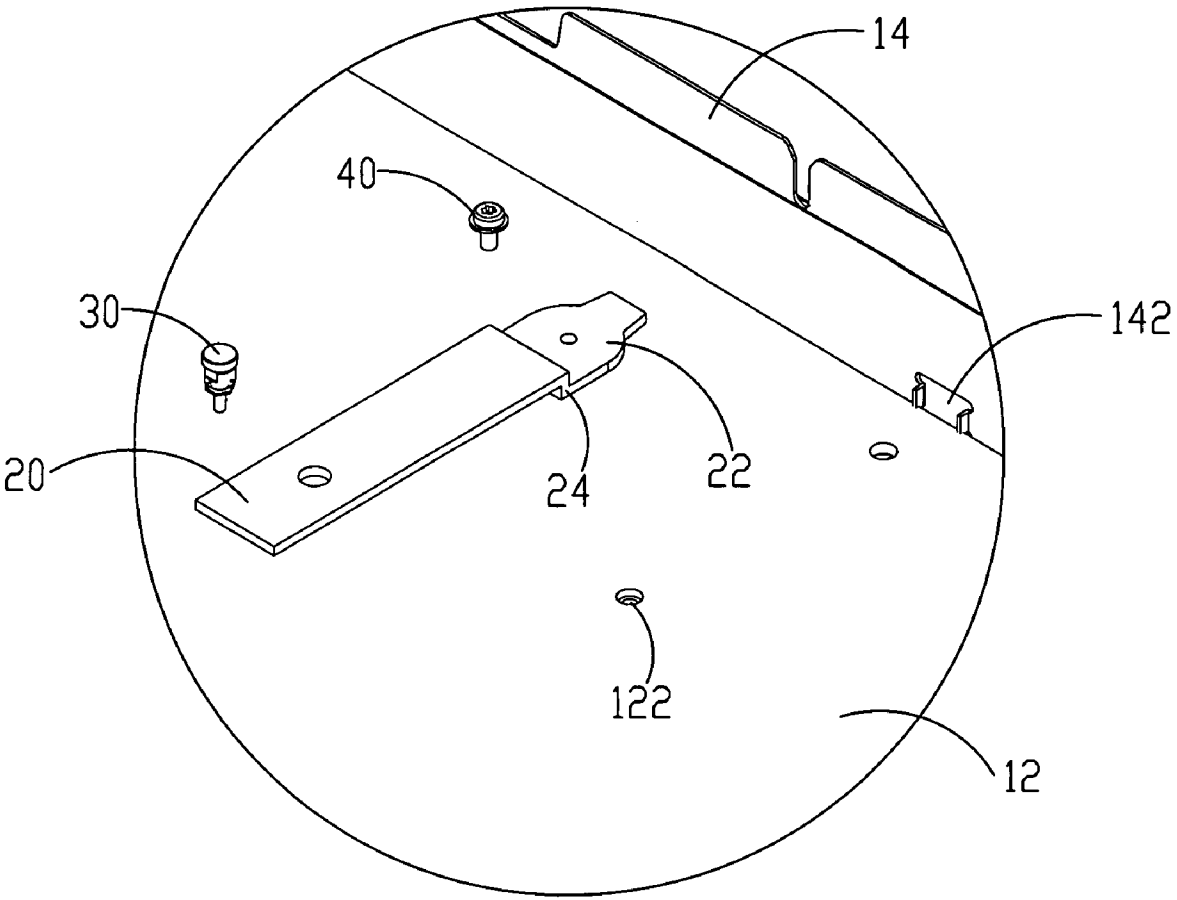
FIG. 1C is a partial enlarged view of the embodiment in FIG. 1B.

Refer from FIG. 1A, FIG. 1B and FIG. 1C, an electronic device 10 consists of an electronic member 12 and a housing 14 while the electronic member 12 is disposed inside the housing 14. A removing member including a releasing member 20 and a fixing member 30 is arranged on the electronic member 12. The releasing member 12 is pivoted on one side of the electronic member 12 while a pulling part 22 is disposed on a first end of the releasing member 12. A slot 142 is mounted on one side of the housing 14 and the pulling part 22 is inserted inside the slot 142. The fixing member 30 is arranged on a second (the other) end of the releasing member 20 and is mounted in a fixing hole 122 of the electronic member 12.

When the electronic member 12 is assembled inside the housing 14, the fixing member 30 is inserted into the fixing hole 122 and the pulling part 22 is located into the slot 142 so that the electronic member 12 will not get damaged while being disassembled or during transportation.

The device further includes a locating member 40 that is a stud. By means of the locating member 40 inserting through the releasing member 20 and the electronic member 12, the releasing member 20 is pivoted on one side of the electronic member 12. The locating member 40 is set between the pulling part 22 and the fixing member 30. In order to pull the releasing member 20 with less force, the locating member 40 is arranged closer to the releasing member 20 due to the principle of leverage. Thus it's easier to apply force to the releasing member 20 for driving the pulling part 22.

Figure 2A:
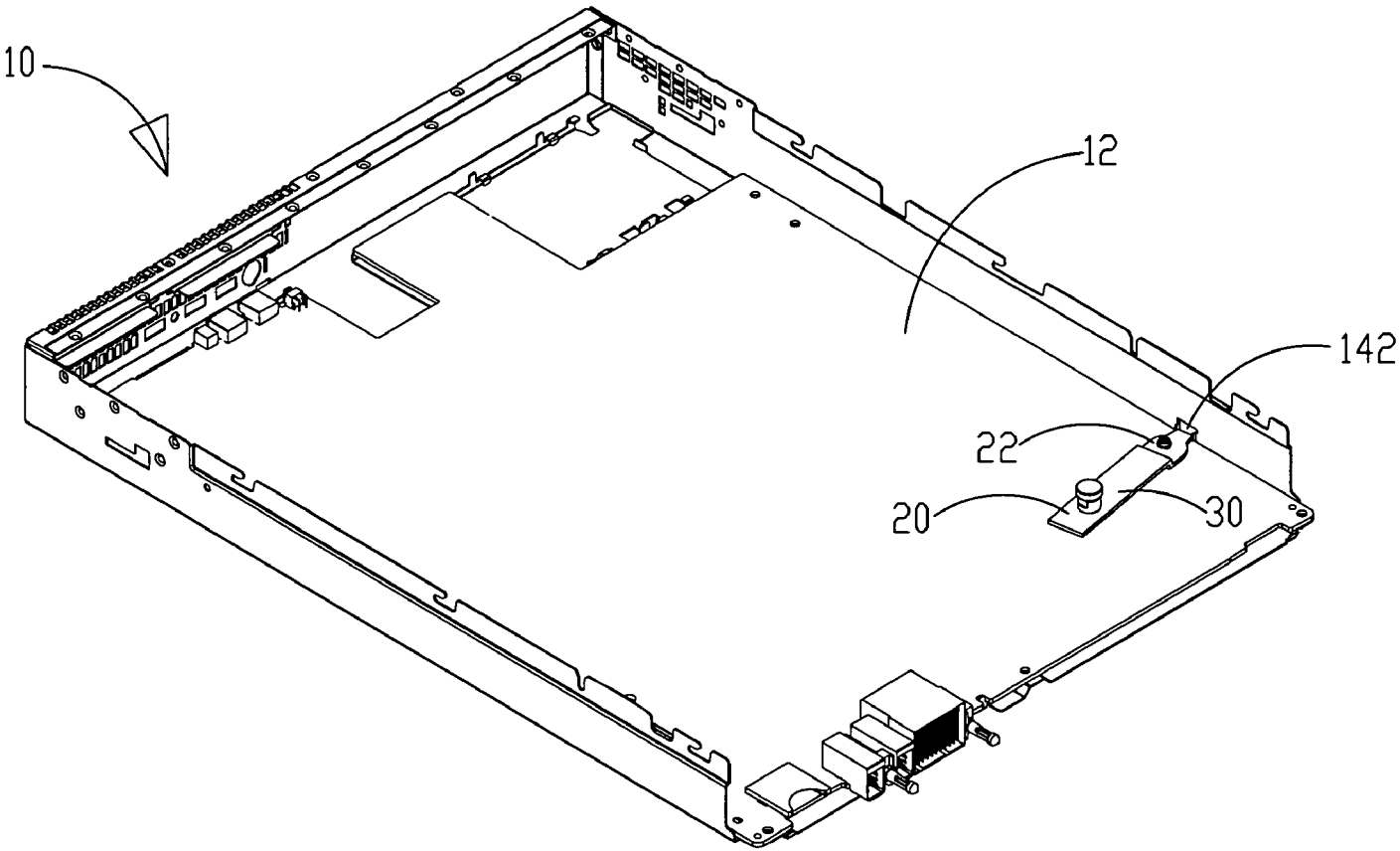
FIG. 2A & FIG. 2B are schematic drawings showing disassembling of an electronic member of an embodiment according to the present invention.

Refer to FIG. 2A, while removing the electronic member 12 from the housing 13, pull the fixing member 30 out of the releasing member 20 and push the releasing member 20 so that the releasing member 20 rotates around the locating member 40. Now the fixing member 30 is on the releasing member 20, away from the fixing hole 122. The pulling part 22 also rotates. The rotating direction of the fixing member 30 is opposite to that of the pulling part 22. The releasing member 20 is continuingly pushed so that the pulling part 22 leans against the slot 142.

Figure 2B:
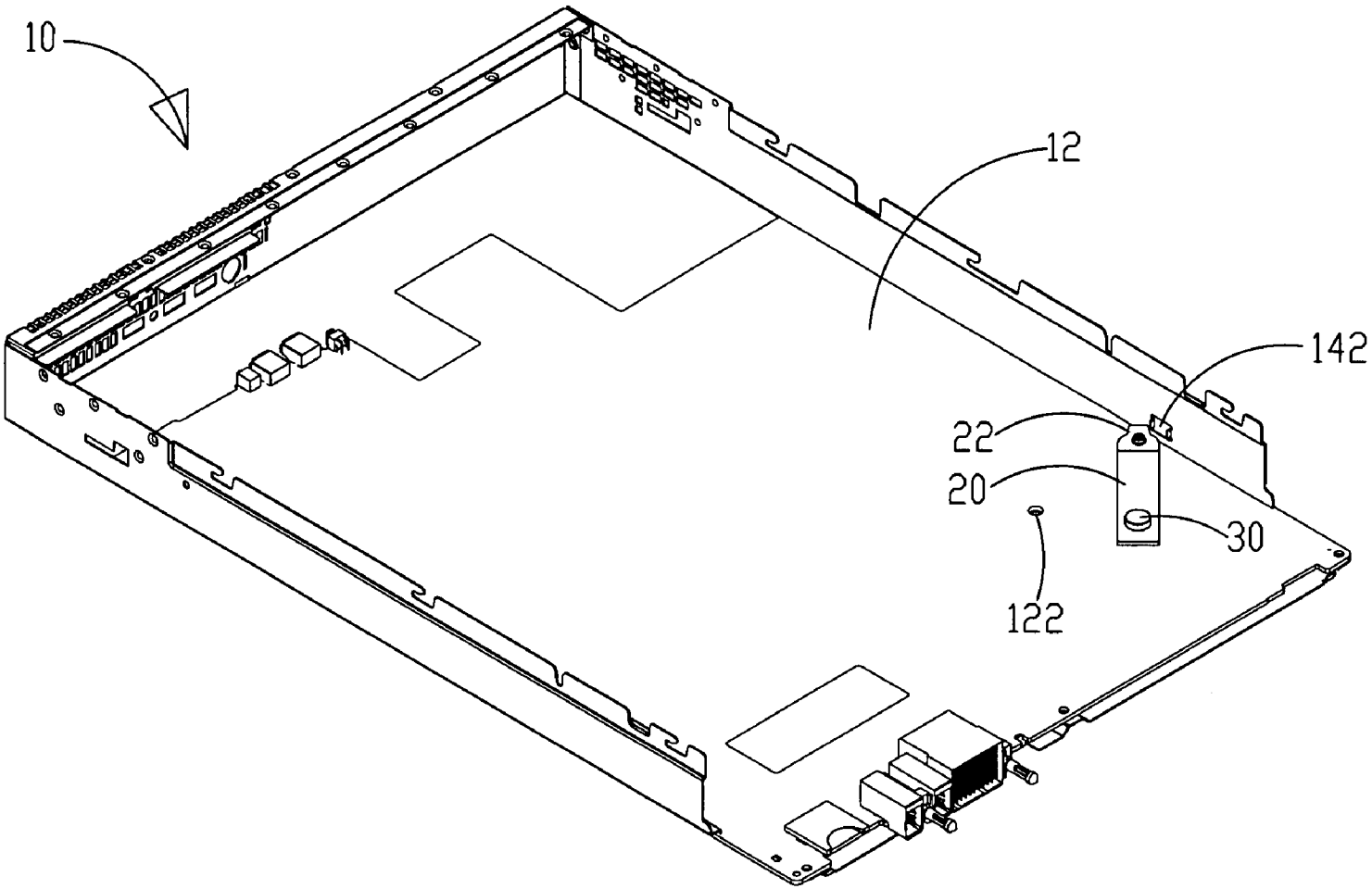

Because the fixing member 30 is tapped on the releasing member 20 and the electronic member 12, the pulling part 22 leaning against the slot 142 generates a counter force so that the electronic member 12, using locating member 40 as a fulcrum point, moves to the opposite direction of the pulling part 22, as shown in FIG. 2B. Thus the electronic member 12 is released.

Once the electronic member 12 is going to be assembled inside the housing 14, the electronic member 12 is set into the housing 14, the pulling part 22 on the releasing member 20 leans against the slot 142 of the housing 14. Keep pushing the electronic member 12 into the housing 14 and the releasing member 20 rotates around the locating member 40. Thus the fixing member 30 on the releasing member 20 gets closer to the fixing hole 122 and finally inserts therein. Moreover, for convenient insertion of the fixing member 30 into the fixing hole 122, an elastic member such as a spring is disposed between the fixing member 30 and the releasing member 20. Thus even the fixing member 30 is pulling up, it will be automatically inserted into the fixing hole 122 by elasticity of the elastic member.

Furthermore, a bending member 24 is arranged on the releasing member 20, between the fixing member 30 and the pulling part 22. The bending member 24 is used to increase the height of the fixing member 30 so as to avoid friction between the fixing member 30 and the electronic member 12 while the releasing member 20 rotating. Thus the electronic member 12 and the elements thereof will not get damage caused by friction.

The electronic member 12 in this embodiment is a motherboard. The present invention can also be applied to other electronic member 12 that is installed by insertion or plugging. For example, the electronic member 12 can be an optical disc driver or a disc driver. By means of the present invention, whether the optical disc driver or the disc drier is firmly installed in the computer is confirmed.

The releasing member 20 and the fixing member 30 can be conductors. The fixing member 30 is a steel bar while the releasing member 20 is a steel sheet. Two sides of the fixing hole 122 are electroplated with metal including tin or gold. The releasing member 20 and the fixing hole 122 respectively are electrically connected with the electronic member 12. Due to conductive property of the releasing member 20 and the fixing member 30, the releasing member 20 and the fixing member 30 not only locate the electronic member 12 but also work as conductive wires when the fixing member 30 is disposed on the releasing member 20. Due to different electrical connection of the releasing member 20 and the fixing hole 122 to the electronic member 12, electricity from the electronic member 12 passes through the releasing member 20, the fixing member 30, to the fixing hole 122. Once the electronic member 12 is not located exactly and the fixing member 30 doesn't contact with the fixing hole 122, the power of the electronic member 12 is off so as to achieve protection effect. Moreover, locating member 40 is also a conductor. Thus by electrical connection between the locating member 40 and the electronic member 12, the locating member 40 passes power to the releasing member 20.

In addition, at least one light source is disposed on top of the fixing member 30. The light source can be a green light emitting diode (LED) and/or a red LED. By the fixing member 30 that is a conductor, power is passed to the light source so that users can check whether the electronic member 12 is exactly installed or removed by different light sources. For example, the green light represents that the electronic member 12 arrives the correct position exactly wile the red light represents that the electronic member 12 has not arrived the right position.

In summary, a removing member for electronics consists of an electronic member and a housing. The electronic member is disposed in the housing and the removing member is arranged on the electronic member. The removing member includes a releasing member pivoted on one side of the electronic member. A pulling part and a fixing member respectively are arranged on sides of the releasing member. The fixing member inserts into a fixing hole of the electronic member while the pulling part is mounted in a slot. When the electronic member is installed inside the housing exactly, the pulling part is located inside the slot so as to avoid damages of the electronic members caused by removing or unexacting assembling.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A removing member for an electronic device that includes a housing and an electronic member disposed inside the housing comprising a removing member disposed on the electronic member and the removing member comprising:

a releasing member pivoted on one side of the electronic member, a pulling part arranged on a first end of the releasing member and a slot arranged on one side of the housing while the pulling part is located inside the slot; and a fixing member is arranged on a second end of the releasing member and is inserted into a fixing hole of the electronic member.

2. The device as claimed in claim 1, wherein the fixing member and the releasing member are conductors while the releasing member and the fixing hole are respectively electrically connected with the electronic member.

3. The device as claimed in claim 2, wherein the fixing member is a steel bar.

4. The device as claimed in claim 2, wherein the fixing member is disposed with at least one light source.

5. The device as claimed in claim 4, wherein the light source is a light emitting diode.

6. The device as claimed in claim 1, wherein two sides of the fixing hole are electroplated with metal.

7. The device as claimed in claim 6, wherein the metal comprising tin.

8. The device as claimed in claim 1, wherein a bending member is arranged on the releasing member and is between the fixing member and the pulling part.

9. The device as claimed in claim 1, wherein the removing member further comprising: a locating member inserting through the releasing member and the electronic member, and located between the pulling part and the fixing member.

10. The device as claimed in claim 9, wherein the locating member is a conductor and the fixing member is electrically connected with the electronic member.

11. The device as claimed in claim 9, wherein the locating member is a stud.

12. The device as claimed in claim 1, wherein the electronic member is a motherboard.

13. The device as claimed in claim 1, wherein the electronic member is an optical disc driver.

14. The device as claimed in claim 1, wherein the electronic member is a disc driver.

* * * * *